US006616155B2

(12) United States Patent
Tuan

(10) Patent No.: US 6,616,155 B2
(45) Date of Patent: Sep. 9, 2003

(54) RESILIENT FORCE-ADJUSTING STRUCTURE FOR SKATE BOARD

(76) Inventor: Chang Tuan, No. 42, Alley 6, Lane 100, Tung Kuang Yuan Road, Taichung (TW)

( * ) Notice: Subject to any disclaimer, the term of this patent is extended or adjusted under 35 U.S.C. 154(b) by 0 days.

(21) Appl. No.: 09/956,947

(22) Filed: Sep. 21, 2001

(65) Prior Publication Data

US 2003/0057670 A1 Mar. 27, 2003

(51) Int. Cl.[7] ..... A63C 17/00
(52) U.S. Cl. ..... 280/87.41; 280/11.28
(58) Field of Search ..... 280/87.041, 87.042, 280/87.043, 11.28, 11.14, 11.225, 11.32, 11.15, 11.27, 628, 629, 220, 265; 411/383, 384, 395; 403/156, 22, 21, 96; 267/292

(56) References Cited

U.S. PATENT DOCUMENTS 1,401,444 A * 12/1921 Roberts ..... 411/395
1,499,448 A * 7/1924 Crawford ..... 280/11.15
1,549,509 A * 8/1925 Schluesselburg ..... 280/11.28
2,275,035 A * 3/1942 Pardon ..... 280/11.28
2,330,147 A * 9/1943 Rodriguez ..... 280/87.041
2,557,331 A * 6/1951 Wintercorn ..... 280/11.28
5,114,166 A * 5/1992 McCosker ..... 280/87.042
5,161,810 A * 11/1992 DeCesare ..... 280/14.21
5,997,018 A * 12/1999 Lee ..... 280/87.042
6,158,752 A * 12/2000 Kay ..... 280/87.042
6,244,605 B1 * 6/2001 Liu ..... 280/87.041
6,286,843 B1 * 9/2001 Lin ..... 280/11.28
2002/0096846 A1 * 7/2002 Chen ..... 280/87.041

* cited by examiner

*Primary Examiner*—Brian L. Johnson
*Assistant Examiner*—Hau Phan
(74) *Attorney, Agent, or Firm*—Troxell Law Office PLLC

(57) ABSTRACT

Resilient force-adjusting structure for skate board including at least two bracket bodies and a resilient mechanism disposed in the bracket body. Each bracket body includes an upper bracket and a lower bracket which are pivotally connected with each other, whereby the upper bracket can swing relative to the lower bracket. The resilient mechanism includes: a resilient body leant on the lower bracket; two stems uprightly fixed on two sides of top face of the upper bracket and passing through the upper bracket from inner side to outer side, each of the stems being formed with an axial thread hole; and two retainers each having a thread rod section and a retaining section disposed at bottom end thereof. Top end of the thread rod section is formed with a driving section. The thread rod sections of the retainers are screwed into the thread holes of the stems with the retaining sections abutting against top face of the resilient body. By driving the driving sections of the retainers, the retainers can be turned to adjust the height of the retainers so as to change the extent to which the retaining sections press the resilient body and adjust the resilient energy of the resilient mechanism.

8 Claims, 5 Drawing Sheets

RESILIENT FORCE-ADJUSTING STRUCTURE FOR SKATE BOARD

BACKGROUND OF THE INVENTION

The present invention is related to a skate board, and more particularly to a resilient force-adjusting structure for skate board, which enables a user to easily adjust the resilience of the skate board.

FIG. 1 shows a part of a conventional skate board. The bracket body 10 is composed of an upper bracket 12 and a lower bracket 14 pivotally connected with each other. The upper bracket 12 can swing left and right relative to the lower bracket 14. The step board 16 is fixedly mounted on the top face of the upper bracket. Two wheels 18 are respectively pivotally connected to two sides of the lower bracket. A resilient mechanism is mounted in the bracket body.

The resilient mechanism includes two resilient members 20 respectively mounted on two sides of the bracket body. Each resilient member has an upper and a lower spring seats 22, 24 and a spring 25. The upper and lower spring seats 22, 24 are respectively locked on upper and lower brackets 12, 14 by screws 23 passing through through holes 15 thereof. The spring 25 is fitted between the two spring seats 22, 24. When a user treads the step board 16 and makes it inclined, the skate board can be controlled and turned. The resilient members 20 provide a restoring force for the upper bracket.

In the above arrangement, the springs 25 have constant resilient force. Therefore, when adjusting the resilient state between the upper and lower brackets, the position of the resilient members must be changed. As shown in FIGS. 1 and 2, each side of top face of each of the upper and lower brackets 12, 14 is formed with three through holes 15. When the resilient member 20 is locked at the outermost through hole 15*a*, a maximum resilient force is achieved. Reversely, when the resilient member 20 is locked at the innermost through hole 15*b*, a minimum resilient force is provided.

In the case that the user is not satisfied with the maximum resilient state of the resilient member, as shown in FIG. 2, a column-like rubber bar 26 can be fitted in the spring 25, whereby the upper and lower spring seats 22, 24 can compress the rubber bar 26 to enhance the resilience of the resilient member.

However, the above structure still has some shortcomings as follows:

1. When adjusting the resilient energy of the resilient members, it is necessary to detach the upper and lower spring seats 22, 24 and then lock the same at other through holes 15. Such procedure is quite troublesome and time-consuming. Also, it is inconvenient to add the rubber bar 26 into the spring.
2. There are only three positions for the resilient members to change the resilient force. In other words, the resilient force can be only adjusted stage by stage so that the variation of the resilience is limited and it is impossible to precisely adjust the resilient force.

SUMMARY OF THE INVENTION

It is therefore a primary object of the present invention to provide a resilient force-adjusting structure for skate board, which enables a user to easily adjust the resilience of the skate board.

It is a further object of the present invention to provide the above resilient force-adjusting structure for skate board, which enables a user to micro-adjust the resilience of the skate board within a larger range.

The present invention can be best understood through the following description and accompanying drawings wherein:

DETAILED DESCRIPTION OF THE PREFERRED EMBODIMENT

Figure 1:
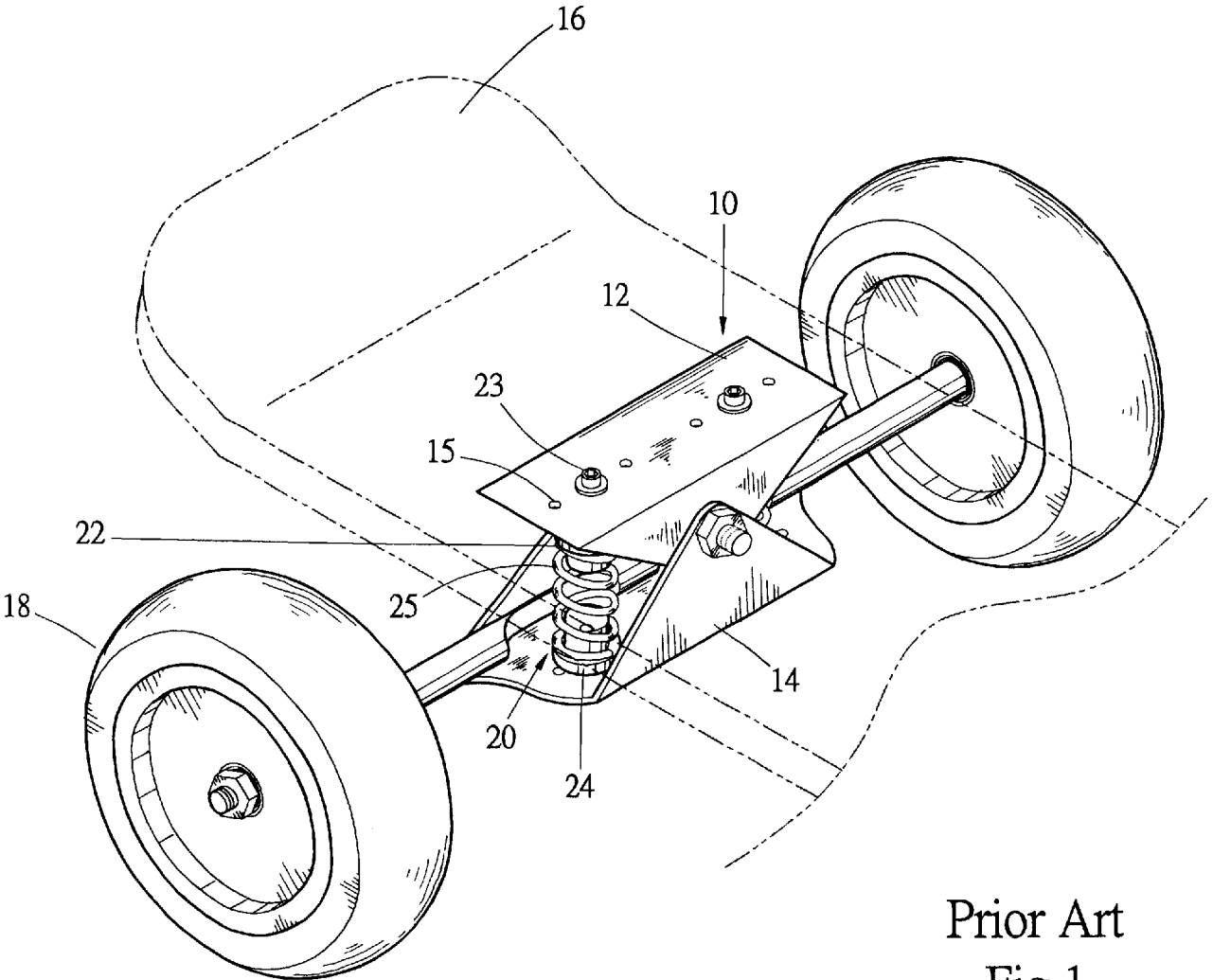
Prior Art Fig.1
FIG. 1 is a perspective assembled view of a resilient mechanism of a conventional skate board.
Figure 2:
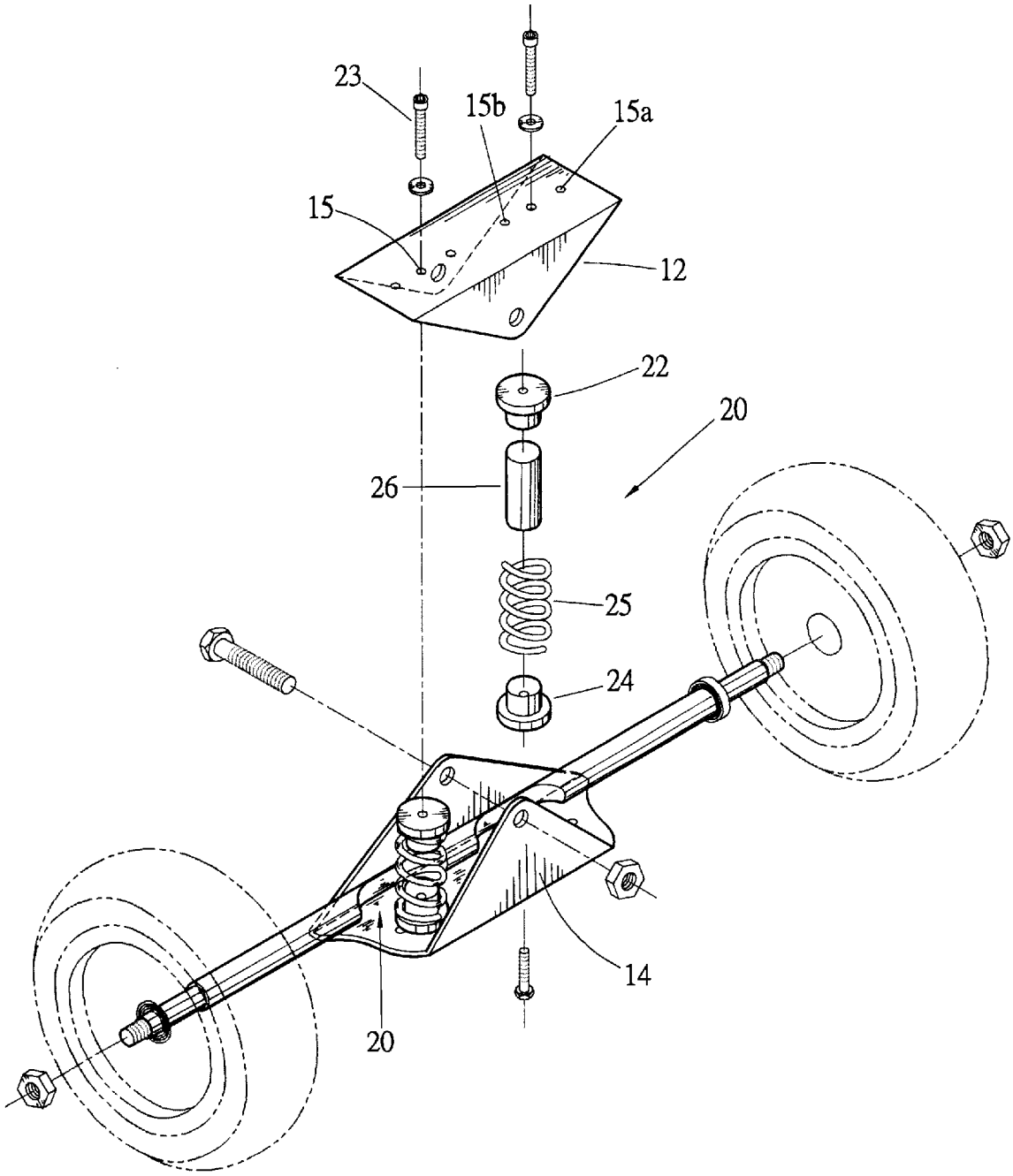
Prior Art Fig.2
FIG. 2 is a perspective exploded view according to FIG. 1.
Figure 3:
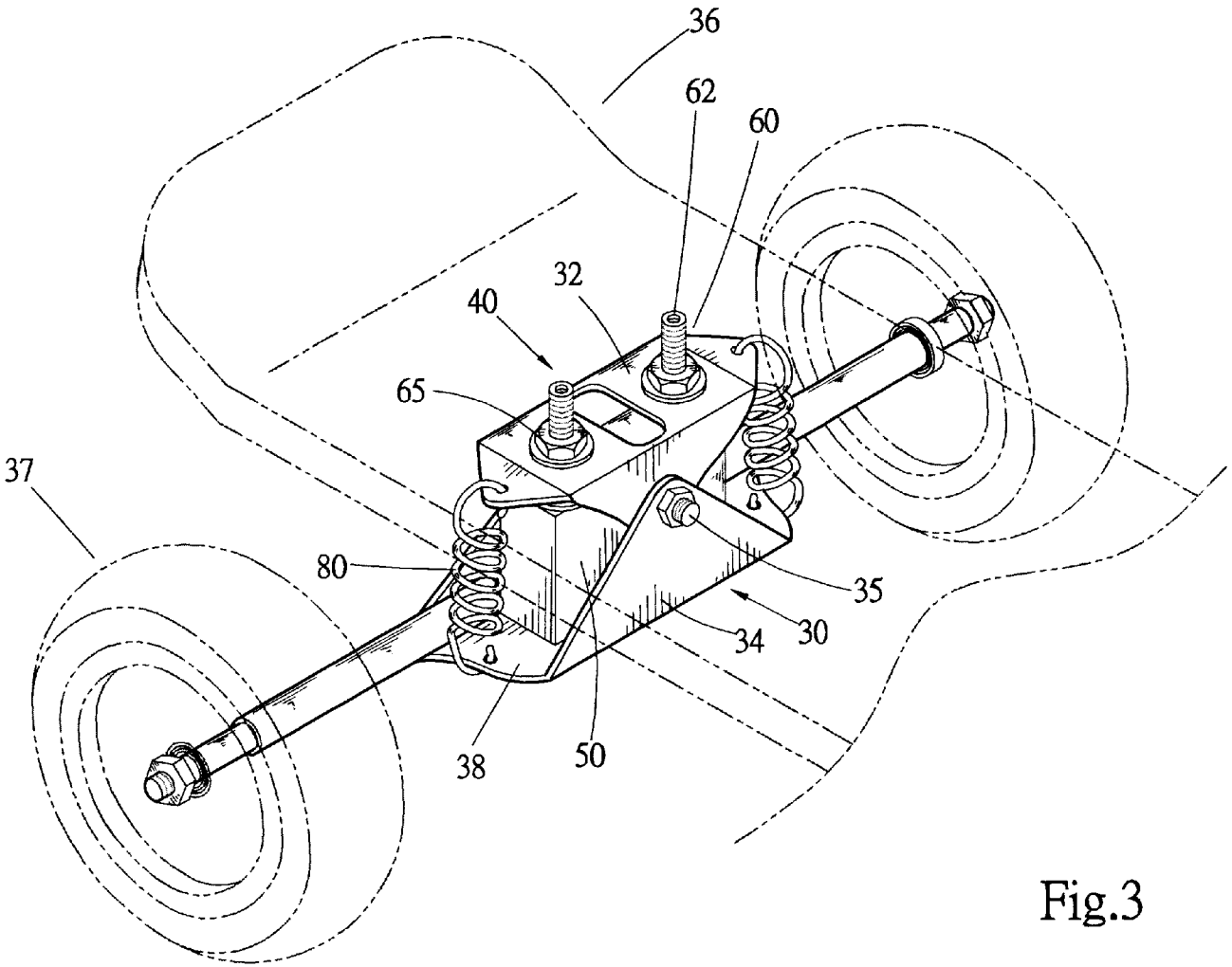
FIG. 3 is a perspective assembled view of a preferred embodiment of the present invention.
Figure 4:
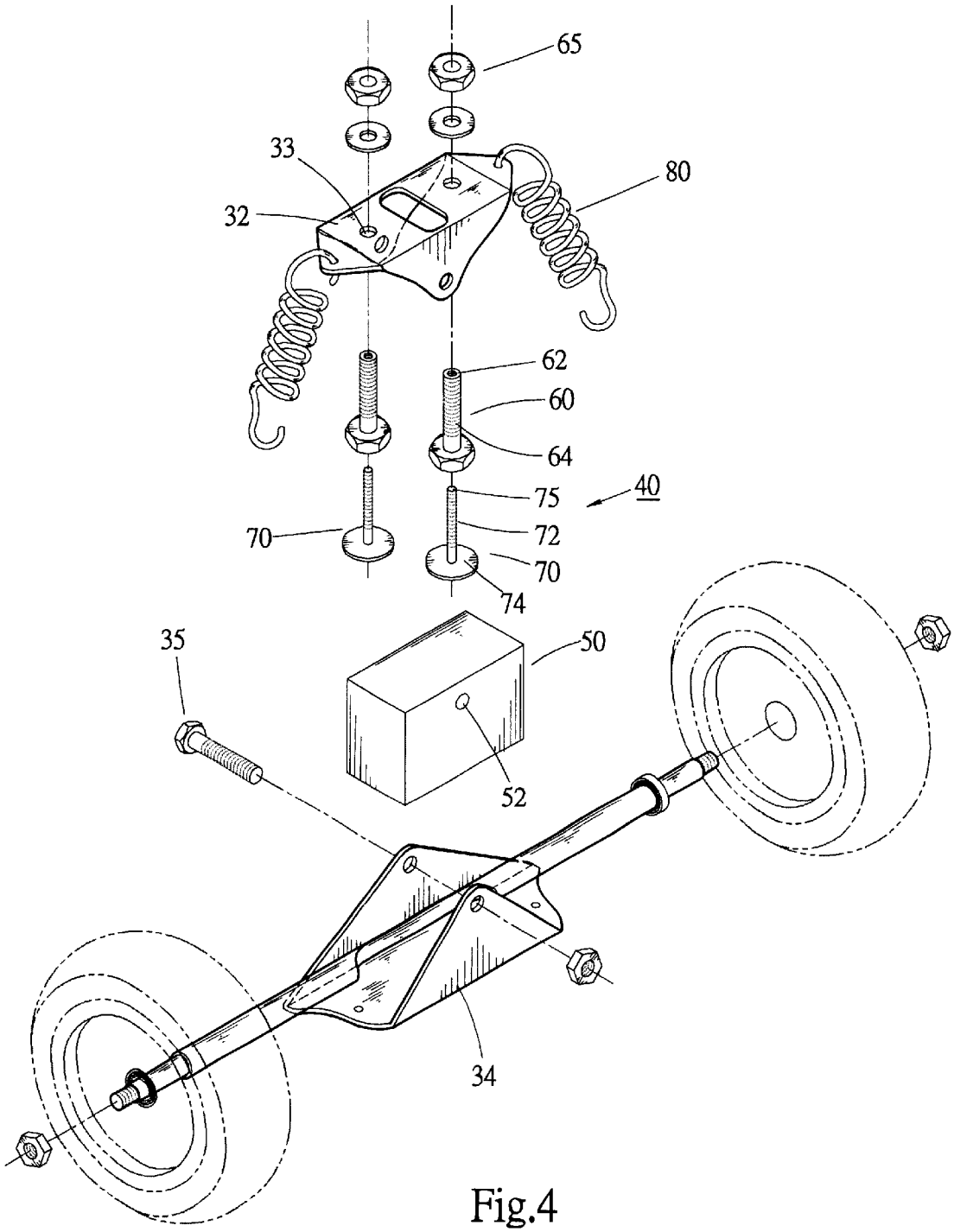
FIG. 4 is a perspective exploded view according to FIG. 3.

Please refer to FIGS. 3 and 4 which show the resilient force-adjusting structure for skate board of the present invention. The skate board has two bracket bodies 30 (only one is shown). Each bracket body includes an upper bracket 32 and a lower bracket 34. The lower bracket 34 is pivotally connected to the upper bracket by a bolt 35, whereby the upper bracket can swing about the bolt relative to the lower bracket. The step board 36 of the skate board is mounted on top face of the upper bracket 32. Two wheels 37 are respectively mounted on two sides of the lower bracket. The upper and lower brackets 32, 34 define therebetween a receptacle 38 in which the resilient mechanism 40 is mounted.

The resilient mechanism 40 has a resilient body 50, two screwed members and two retainers 70.

In this embodiment, the resilient body 50 is a solid rubber block placed in the receptacle 38 and leant on inner wall of the lower bracket 34. The resilient body 50 is formed with a through hole 52 for the bolt 35 to pass therethrough.

Figure 5:
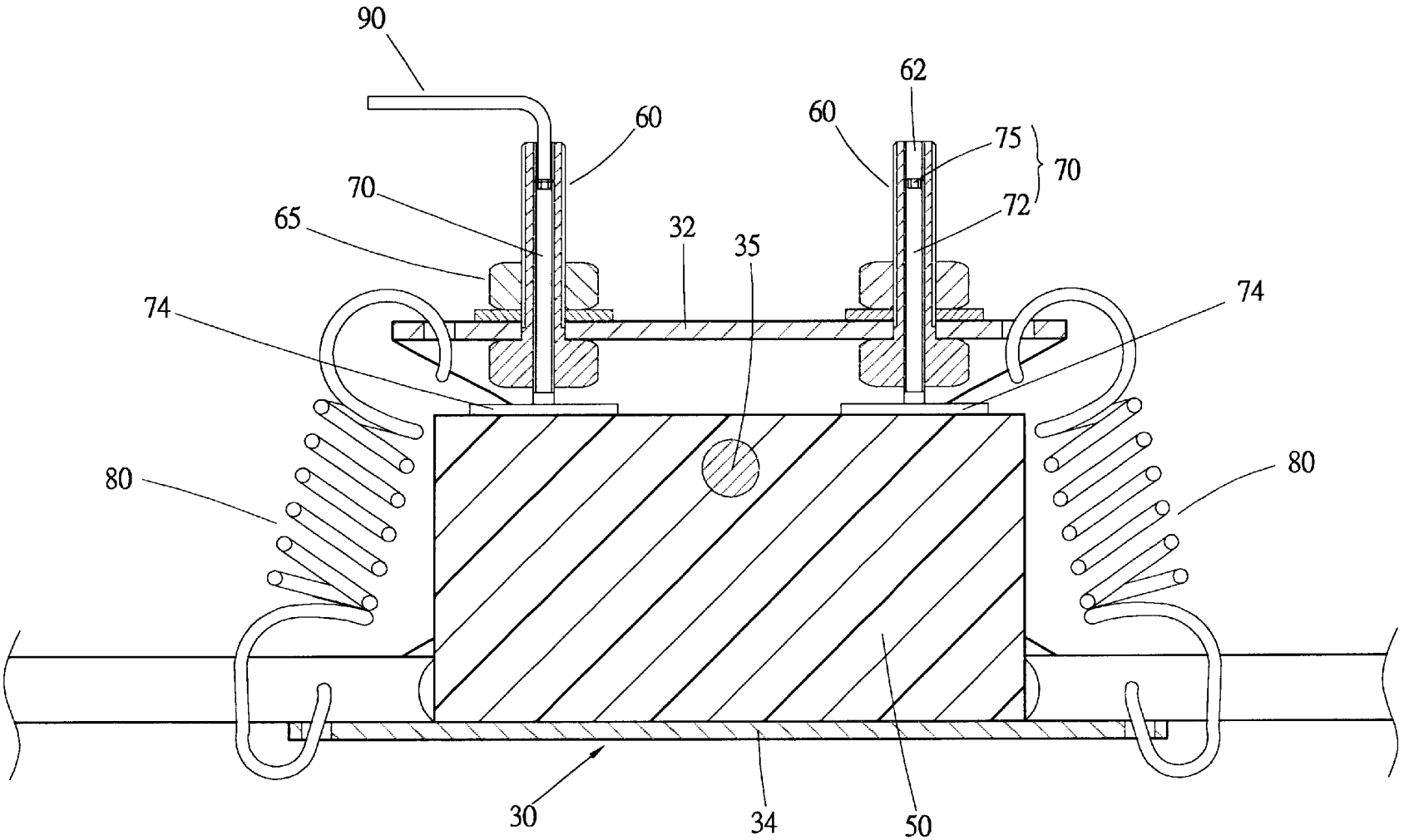
FIG. 5 is a longitudinal sectional view according to FIG. 3.

Each screwed member includes a bolt 60 and a nut 65. The bolt 60 is formed with an axial thread hole 62 passing through the bolt 60 as shown in FIG. 5. The two screwed members are respectively screwed in the through holes 33 on two sides of top face of the upper bracket 32. The stems 64 of the two bolts 60 pass through the upper bracket 32 from inner side to outer side and are positioned on two sides of the pivot of the bracket body 30.

Each retainer 70 has a thread rod section 72 and a disc-like retaining section 74 fixed at bottom end of the thread rod. The top end of the thread rod section 72 is formed with a hexagonal socket serving as a driving section 75. The thread rod section 72 of the retainer 70 is upward screwed into the thread hole 62 of the bolt 60 with the retaining section 74 abutting against the top face of the resilient body 50.

The present invention further includes two resilient members 80 which in this embodiment are two extension springs respectively disposed on two sides of the bracket body. Two ends of each resilient member 80 are respectively hooked with the upper and lower brackets 32, 34.

In use, as shown in FIG. 5, when a user treads the step board 36 to drivingly swing the upper bracket 32, the retaining section 74 of the retainer 70 on a downward swinging side will downward press the resilient body 50. At this time, the resilient body 50 reserves a resilient energy for providing resilient restoring force for the upper bracket 32 to swing back. Moreover, when the upper bracket swings, the resilient members 80 provide auxiliary resilient force for the upper bracket.

When it is desired to adjust the resilient state of the resilient mechanism 40, as shown in FIG. 5, a hexagonal wrench 90 is extended into the thread hole 62 of the bolt 60 and fitted into the driving section 75 of the retainer 70. By means of the wrench, the user can turn the retainer 70. At this time, the thread rod 72 cooperates with the thread hole 62 so that the retainer can be adjusted in height to change the extent to which the retaining section 74 presses the resilient body 50. Accordingly, the resilient energy of the resilient mechanism can be adjusted.

The present invention has the following advantages:

1. When adjusting the resilience of the resilient mechanism, it is unnecessary to detach the resilient mechanism. Instead, the user only needs to directly adjust the height of the retainer so as to change the extent to which the retainer presses the resilient body. Therefore, the adjustment can be conveniently and quickly performed.
2. The height of the retainer can be freely adjusted so that the resilience of the resilient mechanism can be stagelessly adjusted. Accordingly, the micro-adjustment is achievable and the range of adjustment is enlarged.

The above embodiment is only used to illustrate the present invention, not intended to limit the scope thereof.

What is claimed is:

1. Resilient force-adjusting structure for a skate board comprising at least two bracket bodies, each bracket body including an upper bracket and a lower bracket which are pivotally connected with each other, whereby the upper bracket can swing about a fulcrum relative to the lower bracket, the upper and lower brackets defining therebetween a receptacle in which a resilient mechanism is mounted, the resilient mechanism including:

a resilient body disposed in the receptacle and leant on the lower bracket;

two stems uprightly fixed on a top face of the upper bracket and positioned on two sides of the fulcrum of the bracket body, the stems passing through the upper bracket from an inner side to an outer side, each of the stems being formed with an axial thread hole passing through the stem; and two retainers each of which has a thread rod section and a retaining section disposed at bottom end of the thread rod section, a top end of the thread rod section being formed with a driving section, the thread rod sections of the retainers being upward screwed into the thread holes of the stems with the retaining sections abutting against a top face of the resilient body, whereby by means of driving the driving sections of the retainers, the retainers can be turned to adjust the height of the retainers so as to change the extent to which the retaining sections press the resilient body and adjust the resilient energy of the resilient mechanism.

2. Resilient force-adjusting structure for skate board as claimed in claim 1, wherein the resilient mechanism includes two screwed members each of which includes a bolt and a nut, the two screwed members being respectively screwed in two sides of top face of the upper bracket, the two bolts having two stems forming said stems.

3. Resilient force-adjusting structure for skate board as claimed in claim 1, wherein the resilient body is a rubber block.

4. Resilient force-adjusting structure for skate board as claimed in claim 1, wherein the driving section is a hexagonal socket formed on top end of the thread rod section.

5. Resilient force-adjusting structure for skate board as claimed in claim 1, further comprising two resilient members which are respectively disposed on two sides of the bracket body and positioned between the upper and lower brackets.

6. Resilient force-adjusting structure for skate board as claimed in claim 5, wherein the resilient member is an extension spring two ends of which are connected to the upper and lower brackets.

7. Resilient force-adjusting structure for skate board as claimed in claim 1, wherein the retaining section is disc-like.

8. Resilient force-adjusting structure for skate board as claimed in claim 1, wherein the upper and lower brackets are pivotally connected with each other by a bolt serving as the fulcrum, the resilient body being formed with a through hole through which the bolt passes.

* * * * *